US005331996A

United States Patent [19]

Ziehm

[11] Patent Number: 5,331,996

[45] Date of Patent: Jul. 26, 1994

[54] DUAL MODE HOT WATER CIRCULATION APPARATUS

[76] Inventor: Raymond G. Ziehm, 6650 S. Sheridan Blvd., Littleton, Colo. 80123

[21] Appl. No.: 134,307

[22] Filed: Oct. 8, 1993

[51] Int. Cl.[5] ..... F17D 1/16

[52] U.S. Cl. ..... 137/14; 137/337; 137/895

[58] Field of Search ..... 137/895, 337, 14, 563; 237/19; 126/362

[56] References Cited

U.S. PATENT DOCUMENTS

| | | | |
|---|---|---|---|
| 1,109,682 | 9/1914 | Karrander | 137/895 |
| 1,351,779 | 9/1920 | Mather . | |
| 1,404,365 | 1/1922 | Hackman . | |
| 1,663,271 | 3/1928 | Kehm . | |
| 1,730,736 | 10/1929 | Knudsen . | |
| 1,780,379 | 11/1930 | Durdin . | |
| 1,844,613 | 2/1932 | Thompson . | |
| 1,969,460 | 8/1934 | Glenn . | |
| 2,039,275 | 4/1936 | McGrael | 137/895 |
| 2,255,460 | 9/1941 | Weaver . | |
| 2,830,612 | 4/1958 | Taylor | 137/337 |
| 2,915,080 | 12/1959 | Holmes . | |
| 3,097,661 | 7/1963 | Lee . | |
| 3,473,481 | 10/1969 | Brane . | |
| 3,556,124 | 1/1971 | Walton . | |
| 3,929,153 | 12/1975 | Hasty . | |
| 4,142,515 | 3/1979 | Skaats . | |
| 4,236,548 | 12/1980 | Howard . | |
| 4,331,292 | 5/1982 | Zimmer | 137/337 |
| 4,424,767 | 1/1984 | Wicke et al. . | |
| 4,638,944 | 1/1987 | Kujawa et al. . | |
| 4,713,525 | 12/1987 | Eastep . | |
| 4,936,289 | 6/1990 | Peterson . | |
| 5,063,787 | 11/1991 | Khuzai et al. . | |
| 5,072,717 | 12/1991 | Laing et al. . | |
| 5,129,034 | 7/1992 | Sydenstricker . | |
| 5,183,029 | 2/1993 | Ranger . | |

*Primary Examiner*—A. Michael Chambers

[57] ABSTRACT

A dual mode water circulation apparatus to provide instantaneous hot water to faucets remote from the heater in residential or small commercial building water systems. The apparatus comprises a cold water heat exchanger, a high sensitivity check valve, and an aspirator incorporated into a single unit.

The heat exchanger is a chamber installed in the cold water supply line, containing a cooling tube exposed to the water. The check valve has a neutral buoyancy poppet and closes against an angular seat. The aspirator has a reduced cross section nozzle inside a tapered chamber connected to the water supply pipe, with a low pressure tap in the chamber bore.

The apparatus is installed at an angle to the horizontal. The cooling tube is connected to a water return line from a tee in the hot water pipe at the remote faucet. The water circulation loop is from the remote hot water faucet to the heat exchanger portion of the apparatus, to the check valve, then to the aspirator and into the cold water supply to the heater.

A continuous, low rate convective flow is induced in the loop by the heat exchanger, and a higher rate aspirated flow is present whenever water is used in the building. The apparatus is self regulating in response to user needs.

5 Claims, 3 Drawing Sheets

DUAL MODE HOT WATER CIRCULATION APPARATUS

BACKGROUND AND SUMMARY OF THE INVENTION

This invention relates to providing instantaneous hot water to remote faucets in residental or small commercial buildings. Providing instantaneous heated water to remote hot water faucets has proven to be a difficult task when hot water use at the faucet is sporatic. The inconvenience of turning on the water and waiting for hot water to flow from the heater to the remote faucet is agravated in ranch style and two story homes where hot water lines can achieve lengths of 25 meters or more. It is also wasteful of energy and water to run water down the drain while waiting for the hot water to reach the faucet.

Many system approaches and components have been tried with only qualified success. These approaches generally employ one of two basic concepts: (1) Heating the water locally, and (2) circulating hot water from the heater to the remote faucet and back to the heater through a separate return line.

The concept of heating the water in the vicinity of the faucet involves installation of a separate water heater, usually located in the basement close to the remote faucet. These heaters are normally smaller units than the principal building water heater, however still involve all the necessary installation provisions such as an energy source, a gas line for example, and significant plumbing modifications, as shown in U.S. Pat. No. 4,236,548 to Howard. Depending upon the geometry of the installation, the remote heater may still be some distance from the remote faucet, with the result that the delay in receiving heated water is merely reduced. The time reduction will be in direct proportion to the change in the distance from the effective heater to the faucet.

Small undersink heating units such as described in U.S. Pat. No. 1,351,779 to Mather are much closer to the faucet and provide hot water almost immediately. However, these units are generally designed to provide extremely hot water for direct use in making soups or tea and must be mixed with cold water to be of use for typical functions such as hand washing or dish washing. They are often connected to a separate faucet, and constitute a safety hazard due to their extreme high temperature. In addition, they normally have a limited size hot water reservoir that is quickly expended. The undersink units are electrically heated which is costly to operate, and adds the expense of providing an electrical power outlet for the unit.

The systems that use a hot water circulation approach can be broken into two distinct group; pumped circulation, and convective circulation.

Pumped circulation systems such as shown in U.S. Pat. No. 4,142,515 by Skaats, and in U.S. Pat. No. 4,936,289 to Peterson, are effective in providing instantaneous hot water for large commercial buildings, however they have several drawbacks for the average residential or small commercial building. Many new components are added including either timers or thermostats/electronics, a motor, impeller, seals, bearings, wiring, and switches, with their attendant increase of cost and decrease in reliability. They are insensitive to hot water requirements since the pump is controlled by the timer or thermostat and will run on a preset schedule with no regard to hot water needs, thereby wasting the energy to run the pump. Also, heat is lost due to keeping the water line hot at all times, even when no one is in the building, and at night. Electrical power must be supplied through a power outlet installed near the pump. Although the pump motor is small, a humming noise may be transmitted through the pipe to other parts of the building when the pump is running, which may be distracting to some people.

Convective circulation as shown in U.S. Pat. No. 3,097,661 to Lee, and U.S. Pat. No. 3,929,153 to Hasty for example, appears to be a more sophisticated approach in that it uses gravity as the moving force, and has only one moving part, the closure device in a check valve. The initial drawback with a simple convective system is that it requires an upward sloping hot water line to the faucet, and a downward sloping water return line to induce good circulation as discussed by Hasty. In an existing building, the upward sloping line to the faucet is difficult and expensive to achieve.

A more significant problem with a simple convective approach is that with a design that has a circulation flow adequate to keep hot water at the remote faucet, considerable heat is wasted in keeping the pipe hot at all times as discussed by Skaats. In this approach, the return line must be sized large enough to allow a significant flow rate, and the hot water pipe to the remote faucet is kept near heater temperature. Heat loss is proportional to the temperature difference between the pipe and the surrounding environment, so the high temperature of the pipe causes excessive heat losses. Another problem with a simple convection system is that of undesirable heating of the cold water pipe as also discussed by Skaats. Heating of the cold water pipe occurs as a result of the hot water being continuously circulated back to the cold water inlet to the heater and associated pipes. To draw cold water from a cold water faucet in this situation, requires running water to the drain until the warm water is purged which is wasteful of time, water, and heat. If the return line is orificed to reduce the flow rate to minimize these effects, then the convection flow rate will be too low to maintain the pipe hot during periods of infrequent water use. Thus, a simple convective flow circulation system is totally insensitive to hot water needs, and wastes heat most of the time in order to provide heated water to the remote faucet in a timely fashion when it is needed.

It is therefore the principal objective of the present invention to provide a hot water circulation apparatus that when installed in a water system will supply heated water instantaneously to remote hot water faucets in response to user needs. It should also be self regulating to avoid waste of water or energy, and to avoid excessive heating of the cold water system. The apparatus should be reliable, easy to install, economical, and maintenance free.

BRIEF DESCRIPTION OF THE INVENTION

DETAILED DESCRIPTION OF THE INVENTION

The dual mode hot water circulation apparatus is comprised of three key functional elements: a cold water heat exchanger, a venturi or aspirator, and a neutral buoyancy check valve.

Figure 1:
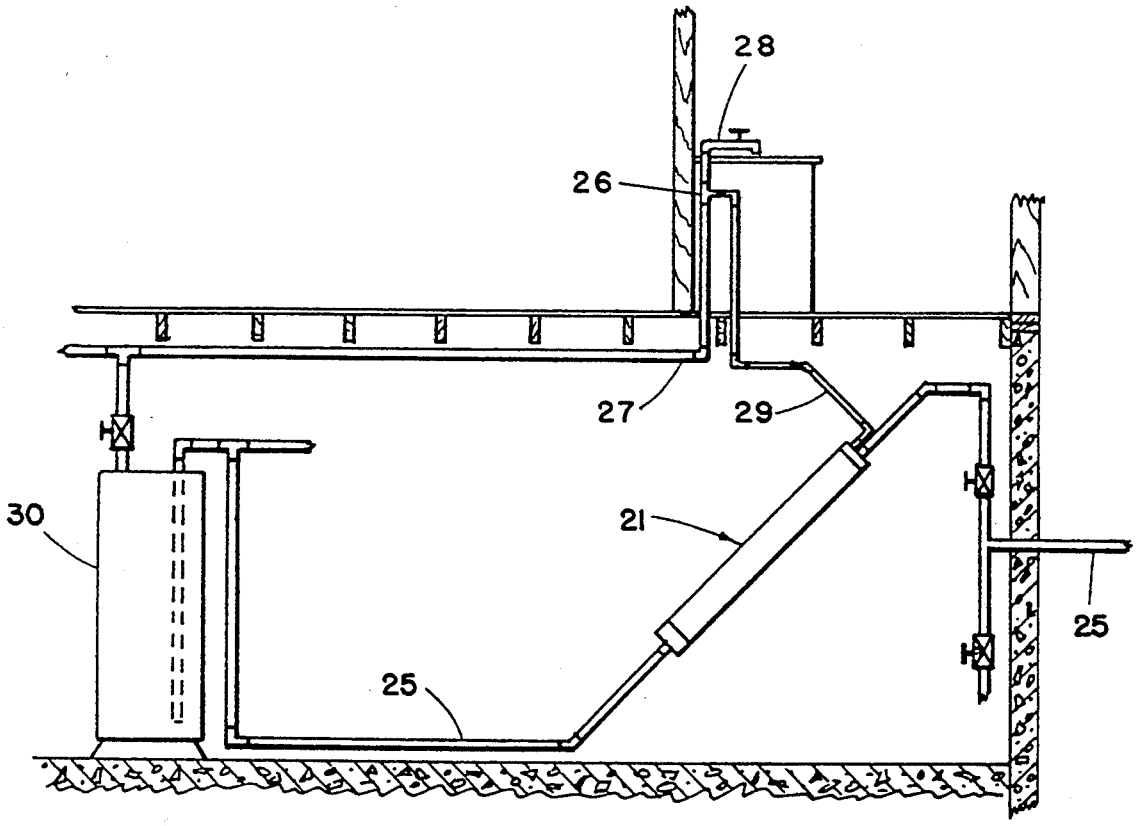
FIG. 1 is a pictoral diagram of the dual mode hot water circulation apparatus of the present invention as installed in a typical residential water system.

Referring to FIG. 1, the apparatus 21 is installed in the water supply pipe 25, and to a tee 26 in the hot water pipe 27 by a return water line 29 connected to the heat exchanger portion of the apparatus 21. The water return line 29, the dual mode hot water circulation apparatus 21, a portion of the existing water supply pipe 25, the existing water heater 30, and the existing hot water pipe 27, constitute a water circulation loop to the remote faucet 28 and back to the water heater 30. Installation of the device 21 in the water supply pipe 25 is downstream of lawn and garden sprinkler taps.

Figure 2:
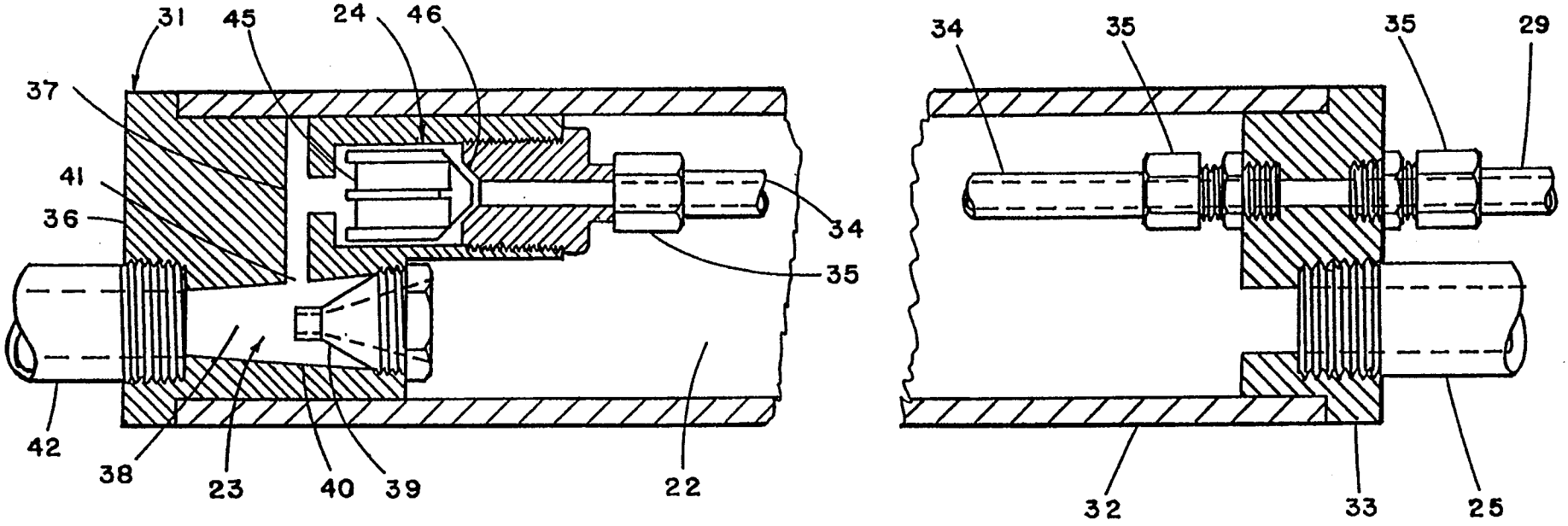
FIG. 2 is a sectional drawing of the dual mode hot water circulation apparatus.

Referring now to FIG. 2, the apparatus 21 includes the cold water heat exchanger 22, and the aspirator 23 plus the check valve 24 contained in an integral aspirator/valve sub-assembly 31. The heat exchanger 22 has a copper tubular housing 32 approximately 2 meters long closed on the inlet end by a cap 33, and a cooling tube 34 located inside the housing 32 that extends from the cap 33 to the aspirator/valve sub-assembly 31. The cap 33 has provisions for in-line installation in the building water supply pipe 25, and fittings 35 to connect the return line 29 to the cooling tube 34 which passes through cold supply water in the heat exchanger 22 with no mixing of return line water with supply water. The outlet end of the heat exchanger tubular housing 32 is closed off by the aspirator/valve sub-assembly 31. The outlet end of the cooling tube 34 is attached to the aspirator/valve body 36 with a tubing fitting 35. The tubular housing 32, the cap 33, and the aspirator/valve sub-assembly 31 are soldered, threaded, or otherwise fastened together to form a single watertight unit.

Figure 3:
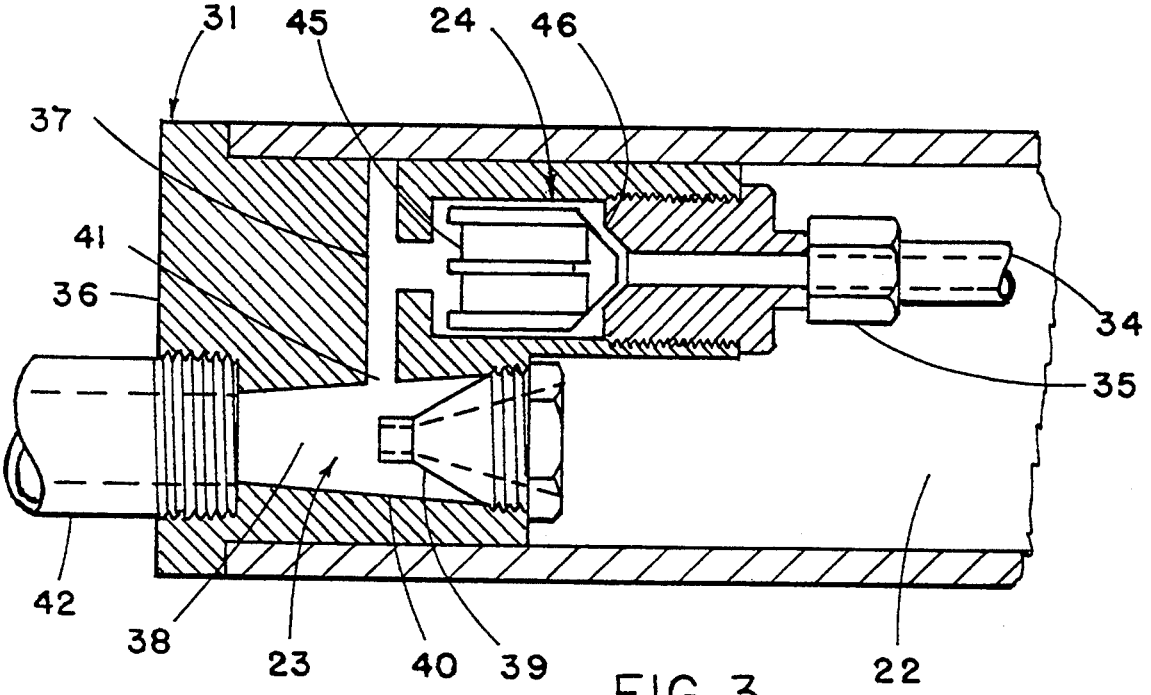
FIG. 3 is a detailed sectional diagram of the aspirator/check valve sub-assembly.

Referring now to FIG. 3, the integral aspirator/valve sub-assembly 31 includes the aspirator 23 sub-assembly, the check valve sub-assembly 24, and internal porting 37. The aspirator/valve body 36 is constructed of brass and is installed so that the cold water supply to the building having first passed through the heat exchanger 22, then passes through the aspirator 23. The internal porting 37 is machined into the aspirator/valve body 36 and is configured to direct the flow of return water from the cooling tube 34 to the check valve 24 and thence to a low pressure chamber 38 in the aspirator 23. The aspirator sub-assembly 23 is comprised of a nozzle 39 that is threaded into a tapered bore 40 in the aspirator/valve body 36. The large, inlet end of the nozzle 39 is open to the water in the heat exchanger 22. A low pressure port 41 drilled into the aspirator bore 40, near the small end of the nozzle 39, is connected to the check valve 24 by means of the internal porting 37. The aspirator outlet pipe 42 is threaded into the aspirator/valve body 36 and has provisions for installation into the water supply pipe 25 leading to the heater.

The check valve sub-assembly 24 includes a poppet with a resultant weight per unit volume equal to that of water, therefore making it neutrally buoyant in water. The poppet 45 has a geometric body shape, nominally a cylinder or triangular prism, with a conic section at one end that seats against a matching angular valve seat 46 threaded into the aspirator/valve body 36. The valve seat 46 is concentric with the aspirator bore and thread. The poppet 45 may be constructed as a solid body from material having a specific gravity of 1.0, or as a hollow body from a material heavier than water. The check valve 24 has no mechanical hinge, springs to overcome, or gate to swing.

Figure 4:
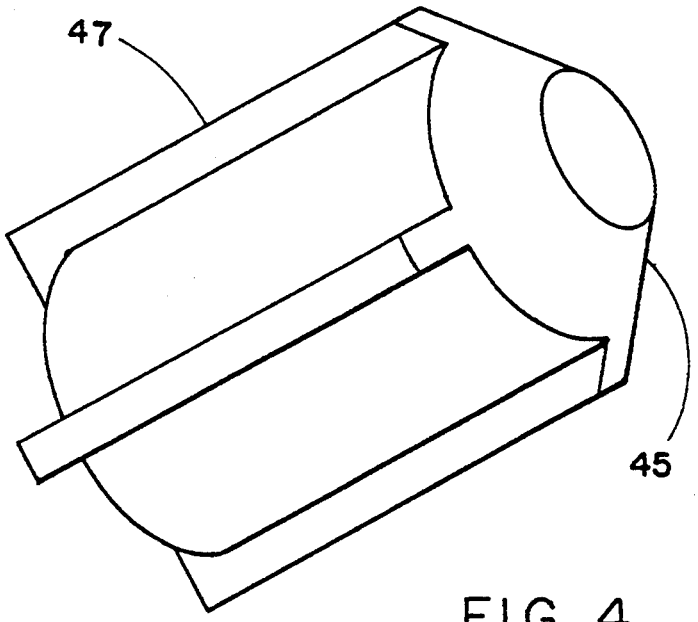
FIG. 4 is a pictoral diagram illustrating the check valve poppet employed in the dual mode hot water circulation apparatus of the present invention.

Referring now to FIG. 4, the poppet 45 shown has a hollow body and a weighs exactly the same as the equivalent volume of water. The poppet 45 internal cavity is sealed to prevent water from entering the cavity, and is dimensionally designed to produce the required poppet weight. The poppet 45 has a plurality of longitudinal ribs 47 extending radially from the cylinder outside diameter that run from the cone interface past the square end of the cylinder as a means to guide the poppet 45 in the bore and allow water to flow around the cylindrical body of the poppet 45. A potential material selection for the hollow poppet is a plastic such as poly vinyl chloride, since it has a specific gravity greater than water that allows for designing the volume of the internal cavity to satisfy weight and volume constraints.

The apparatus 21 is installed at an angle to the horizontal, preferably near the ceiling in the basement, as shown in FIG. 1. The water return line 29 is a small copper tube, nominally 1.0 cm outside diameter. The water return line 29 is connected to the hot water pipe 27 leading to the remote faucet 28, by means of a tee 26 installed as high as possible under the sink at the remote faucet. Referring to FIG. 2, the lower end of the water return line 29, is connected to the cooling tube 34 of the apparatus 21. The exact nature of the fittings 35 to attach the return line 29 to the cooling tube 34 as well as the means of incorporating the apparatus 21 into the water supply pipe 25 is not of significance and as such is not specifically detailed here.

Referring again to FIG. 1, installation of the apparatus 21 includes insulation (not shown) on the hot water pipe 27 from the heater 30 to the high point in the circulation loop, which is at the tee 26 under the sink.

In operation, the apparatus of the present invention is a dual mode water circulation device that provides instantaneous hot water to remote faucets. This is accomplished by creating a continuous, low rate convective flow (Mode 1), plus a higher rate aspirator induced flow (Mode 2), from the water heater 30, through the hot water pipe 27 to the remote faucet 28, through the water return line 29 and the dual mode hot water circulation apparatus 21, and back to the water supply pipe 25 leading to the water heater 30.

During testing prior to installation of this invention, the water temperature at the remote faucet 28 following a period of four or more hours of no water use at the remote faucet 28 ranged from 13 degrees C. in the winter to 15 degrees C. in the summer. It was determined that a water temperature of about 32 degrees C. is very compatible with lavatory needs, and that 41 degrees C. is too hot for comfort for most people. This evaluation was done to develop the target temperature range for Mode 1 operation. The goal was to select a temperature that was as low as possible to keep heat losses at a minimum, yet be hot enough for use at kitchen or bathroom sinks. In addition to the human comfort factor, it is desirable to keep the Mode 1 temperature at the remote faucet 28 in the 27 to 35 degree C. range to minimize the heat required to bring the system up to heater temperature when operating in Mode 2.

The convective, Mode 1 flow is a continuous, low rate flow. Testing has shown that the apparatus will maintain 27 to 35 degree C. water at the remote faucet 28 at all times when no water is being used or has been used in the building during the last three to four hours. Referring now to FIG. 2, the convective flow is caused by the water in the heat exchanger cooling tube 34 passing through the cold water medium of the heat exchanger 22, becoming cooled and thereby more dense than the water entering the heat exchanger from the water return line 29. This causes the cooler water to flow down the cooling tube 34 since the apparatus is installed at an angle to the horizontal, resulting in circulation flow in the loop. The installed angle of the apparatus 21 as shown in FIG. 1 eliminates the requirement for the hot water pipe 27 to be sloped upward, and the water return line 29 to be sloped down. Tests have shown that the convective flow rate is in the order of 50 to 82 cubic centimeters per minute, which is sufficient to keep the water at the remote faucet 28 at the 27 to 35 degree C. temperature. Mode 1 is the effective mode when no water is being used in the building. Mode 1 could be considered a standby mode, since it maintains the water at the remote faucet 28 at a moderately high temperature during periods of inactivity, yet keeps the system ready to respond quickly when water is used, activating Mode 2.

During periods of inhabitant activity, as indicated by water use anywhere in the building, Mode 2 becomes the dominant water circulation force. Referring now to FIG. 3, as water use causes water to flow through the aspirator 23, the high water velocity in the nozzle 39 creates a low pressure in the vicinity of the nozzle outlet. This low pressure causes water to be drawn into the low pressure chamber 38 through the low pressure port 41, and expelled to the water supply pipe 25 to the heater, thus setting up a higher flow rate in the circulation loop. Mode 2 flow rates have been measured in the order of 790 cubic centimeters per minute. Referring again to FIG. 1, this high rate flow quickly brings water at heater temperature, normally about 49 to 50 degrees C., from the heater 30 to the remote faucet 28. Heating of the hot water pipe 27 is quickly and easily accomplished since it was being maintained at the medium hot temperature of 27 to 35 degrees C. by the Mode 1 flow. The combination of Modes 1 and 2 result in hot water service that is very compatible with normal household needs, without the disadvantages of the systems of prior art. By maintaining the hot water pipe 27 at the moderate temperature of Mode 1, heat loss is reduced, and the problem of heating the cold water pipes has not been evidenced. This system is responsive to user needs in that it maintains moderately hot water at the remote faucet 28 while operating in a low loss mode when not being used, yet quickly provides heater temperature water to the user when required. If two or more high flow water outlets such as garden hoses or automatic clothes washers are open simultaneously, a slight decrease in flow rate may be experienced at a third outlet opened at the same time due to the reduced cross section in the aspirator. This has not proven to be an objectionable effect since this condition rarely occurs and the reduction in flow is minor.

The device is responsive to user needs and is self regulating during both modes of operation. When operating in Mode 1, with no water use in the building while inhabitants are away, or during the night, the temperature of the water in the heat exchanger gradually increases toward ambient air temperature. With a smaller temperature differential between the heat exchanger water and the return line water in the cooling tube, the convective flow slows down. On the contrary, when water is being used in the building, cold water will be introduced to the heat exchanger, thereby increasing the differential temperature and convective flow in the circulation loop. This increased convective flow, in conjunction with the intermittant high flow caused by water flowing through the aspirator, will keep hot water at the remote faucet during normal daily household activity, yet operate in an economical manner when water is not being used.

Referring to FIGS. 1 and 3, the check valve 24 is necessary to keep cold water from entering the water return line 29 when the remote faucet 28 is opened. When this faucet is opened, the pressure in the hot water pipe 27 is reduced, thereby lowering the pressure in the water return line 29. When this occurs, the check valve poppet 45 will quickly move with the flow to the valve seat 46, thereby closing the check valve 24 and preventing reverse flow in the water return loop. When the faucet is off, and convective forces build up on the poppet 45, it will move away from the valve seat 46 allowing flow to occur around the cylindrical portion of the poppet 45. The check valve 24 is designed to have high sensitivity to flow in either direction, since the poppet 45 will have extremely low friction in the bore, and no gravity forces to overcome, being essentially weightless in the water. The neutrally buoyant poppet 45 also makes the check valve 24 insensitive to its installation orientation. The insulation on the hot water pipe 27 is used to aid in maintaining as large a temperature difference as possible between the hot water pipe 27 and the water return line 29. The insulation should cover as much of the hot water pipe 27 as possible up to the high point in the circulation loop.

As presented in the preceding paragraphs, it can be seen that this apparatus offers many advantages that a single mode circulation system cannot offer. The most important of these is its responsiveness to user needs. The apparatus will immediately supply water at a temperature suitable for hand and face washing, and many kitchen needs following hours of water system inactivity, yet in seconds can supply heater temperature water for uses that require it. The apparatus is self regulating in that it will reduce the Mode 1 circulation flow when no water is being used, and will increase circulation flow when even intermittant water use, anywhere in the building, signals inhabitant activity. The apparatus is also self regulating in Mode 2 by means of the significant increase in circulation flow rate that occurs when water is being used in the building, thereby bringing heater temperature water to the remote faucet quickly, and reverting back to low loss Mode 1 circulation when water use stops. This results in conservation of heat and water.

The controlled, low rate, Mode 1 circulation flow, will not cause excessive heating in the cold water pipe, thereby avoiding the waste of energy to heat water, and the waste of water into the drain while waiting for the heated water to be flushed from the cold water pipe. With this apparatus, hot water capacity is essentially unlimited, since water is drawn from the main water heater.

A very important feature of this approach is the simplicity of the concept. It contains no pumps, valves, motors, running seals, switches, thermostats, pressure sensors, timers or electronics, which results in low cost, high reliability, low maintenance, and quiet operation.

Installation of the device is simple and straightforward. It requires no sloping pipes, and no electrical power or gas connection, and the water return line can be a small tube. Since the check valve will operate in any physical orientation, the installed angle of the apparatus to the horizontal is not critical. When the remote faucet is opened, the check valve will instantaneously close, since the poppet will have essentially zero friction, no gravity effects, and low mass, thus preventing cold water from entering the water return loop in the reverse direction.

I claim:

1. A method for instantaneous hot water to a plurality of hot water faucets in a building, method comprising steps of:

positioning a hot water circulation apparatus at an angle from the horizontal, the hot water circulation apparatus including a heat exchanger having a cold water chamber, the cold water chamber having a cooling tube positioned therein, the hot water circulation apparatus including aspirator means positioned at an outlet end of the cold water chamber, and a check valve positioned at an outlet end of the cooling tube; and providing a water return line from a most remotely located one of one or more hot water faucets to an inlet end of the cooling tube.

2. A dual mode hot water circulation apparatus for installation in a water supply pipe of a building upstream of a water heater to provide instantaneous heated water to one or more remote hot water faucets in the building that are served by a common hot water pipe, said apparatus comprising:

heat exchanger means including a cold water chamber, the cold water chamber having positioned therein a cooling tube having an inlet end connected to a water return line from a most remotely located one of said one or more hot water faucets to induce convective water flow in a water return loop that comprises said water return line, said hot water circulation apparatus, a portion of said water supply pipe that is downstream of said hot water circulation apparatus, said water heater, and said common hot water pipe;

a check valve positioned at an outlet end of said cooling tube to prevent reverse flow in said water return loop; and aspirator means to create a reduced pressure positioned at an outlet end of said cold water chamber so as to cause an increased flow rate in said water return loop any time water flows in said water supply pipe.

3. An apparatus as in claim 2 wherein said aspirator means comprises: a nozzle positioned at the outlet end of said cold water chamber; a low pressure cavity positioned at an outlet end of said nozzle; a low pressure port coupling said low pressure cavity to said cooling tube at a point downstream of said check valve.

4. An apparatus as in claim 2 wherein said check valve has a closure poppet constructed to have a resultant weight per unit volume equal to that of water.

5. An apparatus as in claim 4 wherein said check valve has a closure poppet constructed to have a resultant weight per unit volume equal to that of water.

* * * * *